US006894011B2

(12) United States Patent
Ellson et al.

(10) Patent No.: US 6,894,011 B2
(45) Date of Patent: May 17, 2005

(54) FABRIC CONDITIONING COMPOSITIONS

(75) Inventors: Karen Jane Ellson, Wirral (GB); Stephane Ugazio, Sophia Antipolis (FR)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 277 days.

(21) Appl. No.: 10/336,318

(22) Filed: Jan. 3, 2003

(65) Prior Publication Data

US 2003/0134771 A1 Jul. 17, 2003

(30) Foreign Application Priority Data

Jan. 4, 2002 (GB) ..... 0200151

(51) Int. Cl.[7] ..... C11D 3/50
(52) U.S. Cl. ..... 510/101; 510/426; 510/507
(58) Field of Search ..... 510/101, 426, 510/507

(56) References Cited

U.S. PATENT DOCUMENTS

| | | | | |
|---|---|---|---|---|
| 3,918,983 | A | 11/1975 | Papalos | |
| 4,062,647 | A | 12/1977 | Storm et al. | |
| 4,713,193 | A | 12/1987 | Tai | |
| 5,358,647 | A | 10/1994 | Puentes-Bravo et al. | |
| 5,443,750 | A | 8/1995 | Convents et al. | |
| 5,833,999 | A * | 11/1998 | Trinh et al. | 424/401 |
| 6,177,389 | B1 * | 1/2001 | Morelli et al. | 510/103 |
| 6,395,701 | B1 * | 5/2002 | Connor et al. | 510/437 |
| 6,491,728 | B2 * | 12/2002 | Bacon et al. | 8/137 |
| 6,500,796 | B1 * | 12/2002 | Ceulemans et al. | 510/513 |
| 6,656,901 | B2 * | 12/2003 | Moorfield et al. | 510/507 |
| 6,787,516 | B2 * | 9/2004 | Moorfield et al. | 510/507 |

FOREIGN PATENT DOCUMENTS

| | | |
|---|---|---|
| EP | 0 469 228 A1 | 2/1992 |
| EP | 0 829 531 A1 | 3/1998 |
| FR | 2199551 A | 4/1974 |
| GB | 0 780 885 | 8/1957 |
| GB | 0 844 929 | 8/1960 |
| WO | 95/22594 | 8/1995 |
| WO | 96/17050 A1 | 6/1996 |
| WO | 97/36976 | 10/1997 |
| WO | 00/24857 | 5/2000 |

OTHER PUBLICATIONS

UK Search Report No. GB 0200151.9, dated Jul. 10, 2002—1 p.
WPI Abstract Acc. No. 1974–44067V of FR 2 199 551.
International Search Report PCT/EP 02/13477, dated May 2, 2003—5 pp.

* cited by examiner

*Primary Examiner*—John R. Hardee
(74) *Attorney, Agent, or Firm*—Ellen Plotkin

(57) ABSTRACT

An aqueous fabric conditioning composition comprises a solid particulate material, perfume and an oil. Preferably the composition is in the form of an emulsion. A method of treating fabrics comprising contacting the fabric conditioning composition with fabrics during a laundry treatment process. The solid particulate material and the perfume in the fabric conditioning composition are used to stabilize the oil.

11 Claims, No Drawings

FABRIC CONDITIONING COMPOSITIONS

TECHNICAL FIELD

The present invention relates to fabric conditioning compositions, to the use of a solid particulate material and a perfume to stabilise oil-containing emulsions and to a method of treating fabrics with the fabric conditioning compositions.

BACKGROUND AND PRIOR ART

Rinse added fabric conditioning compositions are well known. Typically, such compositions comprise a fabric softening agent dispersed in water. The fabric softening agent can be included at up to 8% by weight, in which case the compositions are considered dilute, or at levels from 8% to 60% by weight, in which case the compositions are considered concentrated.

One of the problems frequently associated with conventional fabric conditioner compositions is physical instability upon storage. This problem is usually accentuated when the composition is stored at low temperature (e.g. at 5° C. or below) or at elevated temperatures.

Physical instability can manifest itself as a thickening of the composition. This thickening can occur to a level at which the composition is no longer pourable, and, can even lead to the formation of an irreversible gel. Such thickening is very undesirable because the composition can thereafter no longer be conveniently used and/or it is unattractive to the consumer.

Thus, it is desirable to provide fabric conditioning compositions which, in addition to imparting softness benefits, are stable upon storage and preferably stable across a wide range of low and/or high temperatures since the stored products may experience temperatures as low as 0° C. and as high as 45° C. or even higher.

In addition, fabric conditioning compositions desirably have other properties, including good dispersibility in water and delivery of sufficient amounts of perfume to the fabric being treated and longevity of perfume aroma on laundered fabrics.

Apparent freshness of laundered fabrics can be highly valued by consumers and thus delivery of sufficient perfume can be as desirable, if not more so, than imparting softness to fabrics.

It is also desirable to provide a composition in which the active ingredient for softening comprises a readily available natural source not requiring complicated and expensive formulation prior to incorporation into the composition.

A considerable number of additives have been developed for incorporation in or addition to, for example, the main wash cycles or tumble drying sequence of fabric laundering processes or industrial textile treatment processes in order to impart "softness" benefits.

Thus, it is well known in the art that some clay materials may be used to impart softening and anti-static properties when deposited on fabrics. Such clay deposition is generally achieved by contacting fabrics with high concentrations of an aqueous suspension of the clay under closely controlled conditions during commercial manufacturing and treatment processes.

U.S. Pat. No. 4,062,647 discloses a detergent composition comprising specified amounts of water soluble non-soap synthetic detergent, an inorganic or organic detergent builder salt and a smectite clay with specified cation exchange characteristics. The clay is not pre-treated with any organic compound prior to inclusion in the formulation. According to U.S. Pat. No. 4,062,647, these compositions provide fabric softening and/or anti-static benefits.

In order to provide the improved softening benefits claimed therein, U.S. Pat. No. 5,443,750 discloses detergent compositions comprising a specified cellulase and a softening clay such as, for example, a heat treated kaolin or various multi-layer smectites. The softening clays disclosed in this document have not been pre-treated with organic compounds. According to U.S. Pat. No. 5,433,750, the combination of specified cellulase and clay leads to a synergistic improvement in softness benefits. Preferably, the compositions also comprise a flocculating agent. Liquid detergents further comprise an antisettling agent such as, for example, an organophilic clay (e.g. Bentone®).

U.S. Pat. No. 3,918,983 describes a textile treatment comprising particular sulfated castor oil substitutes and the use of these sulfated derivatives as textile softeners when applied as finishes. The sulfated castor oil substitutes disclosed comprise specified amounts of at least one sulfated aliphatic alcohol, having from about 4 to about 30 carbon atoms, in conjunction with specified amounts of at least one sulfated unsaturated oil, other than castor oil.

WO 00/24857 discloses a laundry detergent product comprising a wrinkle reducing agent selected from one or more of a specified range of compounds, including sulfated and sulfonated vegetable oils.

GB 0844929 discloses a waterless skin cleaner comprising 20 to 70% by weight of a non-polar organic solvent and an organic ammonium clay complex. There is no reference to specific perfume ingredients.

GB 0780855 discloses a coloured foundation cream comprising a pigment and an aqueous emulsion. There is no reference to specific perfume ingredients.

U.S. Pat. No. 4,713,199 discloses a particulate adjunct for detergents in which zeolite is used to carry oily or waxy components such as a nonionic surfactant or perfume. There is no disclosure of aqueous emulsions.

WO-A1-96/17050 discloses a personal cleansing composition comprising. A perfume or cosmetic oil is present and is preferably mineral oil. There is no disclosure of specific perfume ingredients.

It remains desirable to provide a fabric conditioner which can provide fragrance to fabrics at levels desirable to consumers.

It also remains desirable to have improved systems for treating fabric that provide fabric softness and which are stable upon storage.

The present invention aims to provide a fabric conditioning composition affording perfume delivery benefits to fabric treated with the composition. The present invention also aims to provide a fabric conditioning composition which is stable upon storage and imparts good softness to fabrics. The compositions of the invention may also provide one or more other advantages in fabric treated with the compositions, the advantages including one or more of: better shape, body, improved texture, improved colour (including surface colour definition), better antistatic properties, reduced friction, better comfort in wear, increased water absorption and better durability (i.e. resistance to wear).

OBJECTS OF THE INVENTION

The present invention seeks to overcome one or more of the above-mentioned problems and/or to provide one or more of the above-mentioned benefits.

STATEMENT OF INVENTION

According to the present invention, there is provided an aqueous fabric conditioning composition comprising:

(i) a solid particulate material;

(ii) a perfume of which at least 50% by number of the perfume components have a ClogP value equal to or greater than 2.0; and (iii) an oil Preferably the composition is in the form of an emulsion.

In another aspect of the invention, there is provided the use of a solid particulate material and a perfume in an aqueous fabric conditioning composition to stabilise an oil.

In yet a further aspect of the invention, there is provided a method of treating fabrics, comprising contacting an aqueous fabric conditioning composition comprising (i) a solid particulate material;

(ii) a perfume of which at least 50% by number of the perfume components have a ClogP value equal to or greater than 2.0; and (iii) an oil with fabrics during a laundry treatment process.

DETAILED DESCRIPTION OF THE INVENTION

The invention relates to an oil-based composition, preferably an emulsion of oil droplets dispersed in water, in which the oil droplets are stabilised against coalescence by a solid particulate material.

Solid Particulate Material

The solid particulate material may be any solid particulate material compatible with fabric treatment compositions. For example, the solid particulate material may be selected from a clay, a zeolite, a silica and mixtures thereof. The term "particulate", as used to describe the solid material herein, means that the material comprises individual solid particles whose average (by number) size is in the range from 0.01 to 1000 microns.

The fabric conditioning composition preferably comprises a solid particulate material in an amount of from 0.01% to 50% by weight of the composition, more preferably from 0.1% to 20% by weight of the composition, e.g. from 1% to 10% by weight of the composition.

The solid particulate material may be a single solid particulate material or a mixture of different solid particulate materials.

It is particularly preferred that the solid particulate material is a clay as the clay provides softening benefits in addition to perfume delivery to fabrics.

The clay is not subjected to a cation exchange reaction.

The clay typically comprises material classified as smectite-type. Suitable smectite-type clays are preferably impalpable, expandable, three-layer clays such as, for example, aluminosilicates and magnesium silicates having an cation exchange capacity of at least 50 milliequivalents per 100 g of clay. The smectite-type clay preferably has a cationic exchange capacity of at least 75 milliequivalents per 100 g of clay, as determined by the well-known ammonium acetate method.

The term "impalpable" means that the individual clay particles are preferably of such a size that they cannot be perceived tactilely. Such particle sizes are in general below 100 microns in diameter. Preferably, however, the clays will have a particle size (i.e., a maximum dimension) within the range of from 0.01 to 50 microns.

The term "expandable" as used to describe the clays relates to the ability of the layered clay structure to be swollen, or expanded, on contact with water.

Smectite-type clays are well known in the art and are commercially available from a number of sources. In addition, suitable smectite-type clays may be synthesised by a pneumatolytic or hydrothermal process, such as, for example, disclosed in U.S. Pat. No. 3,252,757.

The smectite-type clay is preferably selected from the group consisting of: montmorillonite, bentonite, beidellite, hectorite, saponite, stevensite, and mixtures thereof. Where appropriate, the clays will have been subjected to the application of shear. The smectite-type clays may be sheared by processes well known to those in the art, such as disclosed in U.S. Pat. No. 4,695,402, for example.

More preferably the smectite-type clay is selected from bentonite and hectorite or mixtures thereof.

An additional and/or alternative solid particulate material suitable for use in the composition is zeolite. Zeolites are typically aluminosilicates and synthetic zeolites are commercially available under the designations zeolite A, zeolite B, zeolite P, zeolite X, zeolite HS, zeolite MAP and mixtures thereof. Naturally occurring zeolites may also be used as the solid particulate material. In certain known detergent compositions, zeolites are included as detergent builders. Thus, zeolites are well known to those skilled in the art and need not be described in more detail herein.

Alternatively or additionally, the solid particulate material may be a silica compound.

If the solid particulate material comprises more than one of the above-mentioned particulate material ingredients, then any combination of the ingredients may be present, in any of the amounts described above.

It is believed that the solid particulate material is effective in preventing coalescence of the composition because it coats the oil droplets. Such a composition may be known as a "Pickering emulsion".

Oil

The compositions of the invention comprise an oil.

Suitable oils include mineral/hydrocarbon oils, ester oils, sugar ester oils and/or natural oils such as vegetable oils. However, ester oils or mineral oils are preferred. If the oil is an ester oil, it is especially preferred that the composition also comprises a fatty alcohol, such as hardened tallow alcohol, as the fatty alcohol appears to improve stabilisation of the composition.

Mineral oils are most preferred. Ideally, the mineral oil comprises a hydrocarbon oil containing substantially only carbon and hydrogen. The hydrocarbon oils are preferably substantially free of aromatic components and are fully saturated. Suitable hydrocarbon oils can comprise a mixture of different chain length hydrocarbons, e.g. from $C_8$ to $C_{40}$, having various degrees of branching. The hydrocarbon oils are preferably aliphatic.

Excellent stability and perfume delivery can be achieved when the oil comprises either a mineral oil or an ester oil together with a fatty alcohol as an additional stabilising agent.

The ester oils are hydrophobic in nature. They include fatty esters of mono or polyhydric alcohols having from 1 to 24 carbon atoms in the hydrocarbon chain, and mono or polycarboxylic acids having from 1 to 24 carbon atoms in the hydrocarbon chain, provided that the total number of carbon atoms in the ester oil is equal to or greater than 16, and that at least one of the hydrocarbon chains has 12 or more carbon atoms.

Suitable ester oils include substantially saturated ester oils (i.e. having less than 10% by number of unsaturated carbon-carbon bonds), such as the PRIOLUBES (ex Unichema). 2-ethyl hexyl stearate (PRIOLUBE 1545), neopentyl glycol monomerate (PRIOLUBE 2045) and methyl laurate (PRIOLUBE 1415) are particularly preferred although oleic monoglyceride (PRIOLUBE 1407) and neopentyl glycol dioleate (PRIOLUBE 1446) are also suitable.

Other suitable esters oils include fatty acid glyceride esters as defined in EP-A1-0746603, e.g. palm oil and tallow oil.

Suitable oily sugar compounds include the sugar ester oils defined in WO-A-98/16538, which are hereby incorporated by reference. The oily sugar esters preferably have a viscosity of from 5 to 50 Pa.s, and preferably have a density of from 0.8 to 1.2 $gcm^{-3}$, more preferably from 0.9 to 1 $gcm^{-3}$, most preferably from 0.93 to 0.99 $gcm^{-3}$.

It is preferred that the viscosity of the ester oil is from 0.002 to 2.0 Pa.S, more preferably from 0.004 to 0.4 Pa.s at a temperature of 25° C. at 106 $s^{-1}$, measured using a Haake rotoviscometer RV20 NV cup and bob, and that the density of the mineral oil is from 0.8 to 0.9 $g.cm^{-3}$ at 25° C.

Suitable mineral oils include branched or straight chain hydrocarbons (e.g. paraffins) having 8 to 35, more preferably 9 to 20 carbon atoms in the hydrocarbon chain.

Preferred mineral oils include the Marcol technical range of oils (ex Esso) although particularly preferred are the Sirius range (ex Fuchs), the Semtol range (ex Goldschmidt), and the Merkur Tec range (ex Merkur Vaseline).

The molecular weight of the mineral oil is typically within the range 100 to 400.

The oil may be a silicone oil.

Examples of the silicone oils that may be used as oils in the present invention include polydimethylsiloxanes, preferably having a viscosity of about 10,000 cSt. Commercially available silicones are available from Crompton Corporation, Greenwich, Conn., under the trade name L-45; HALS silicone available from Rhodia US, Cranbury, N.J.; and Silwet L-7622 available from Crompton Corporation.

Any of the oils mentioned herein may be present either alone or in combination.

It is particularly preferred that the oil has substantially no surface activity.

It is believed that the oil provides excellent perfume delivery to the cloth and also increases perfume longevity upon storage of the composition.

Preferably, the oil is present in an amount of from 0.01% to 60% by weight, more preferably from 0.1% to 30% by weight most preferably from 0.1% to 15% by weight of the composition.

It is particularly preferred that the weight ratio of solid particulate material to oil is within the range from 10:1 to 1:10, more preferably from 5:1 to 1:5, even more preferably from 2:1 to 1:2.

Ratios of 2:1 to 1:2 are advantageous over ratios of 5:1 or more because the composition delivers the added consumer benefit of significantly increased perfume intensity.

Functionalised Oil

The compositions of the invention may also comprise a functionalised oil. The functionalised oil may be a single functionalised oil or a mixture of different functionalised oils. In the functionalised oil, the functionalised group will comprise one or more polar functional groups bearing a formal positive or negative charge. The functional group will be associated with a counterion chosen so as not to interfere with the functionalised oil. Suitable counterions may, for example, be chosen from the group consisting of: alkali and alkaline earth metals, ammonium and organic ammonium salts, chloride, bromide, hydroxyl, acetate, nitrite, and mixtures thereof.

The functional group or structural unit preferably comprises one or more of the following polar groups: anionic groups such as, for example, sulfate, sulfonate, phosphate, phosphonate, carboxylate, carbonate, ethoxylate, hydroxyl, nitrate and nitrite; cationic groups such as, for example, $—NH_3^+$, or $—NR_3^+$, where R is an alkyl group containing 1 to 6 carbon atoms, or mixtures thereof. The functional group may be attached or otherwise included in the oil according to any of the methods well known in the art.

Typically, the functionalised oil comprises a functionalised vegetable oil, in which the vegetable oil is preferably selected from the group consisting of: corn oil, coconut oil, soybean oil, cotton-seed oil, castor oil, linseed oil, sunflower oil, palm oil, peanut oil, lanolin, sesame oil, olive oil, avocado oil, truffle oil, rapeseed oil, soyabean oil, maize oil and mixtures thereof.

Preferably, the functionalised oil is a sulphated vegetable oil; more preferably, the functionalised oil is sulphated castor oil.

Methods of synthesising sulphated castor oil from natural materials are well known to those skilled in the art. However, suitable sulphated castor oil may also be obtained commercially from Goodrich under the trade name Freedom SCO-75.

It is particularly preferred that a functionalised oil is present when the solid particulate material comprises a clay. Without wishing to be bound by theory, it is believed that the functionalised oil acts as a dispersing agent for the clay, which results in an improvement in the softening benefit imparted to fabrics.

As well as acting as a dispersing agent, the functionalised oil may also help to suspend the solid particulate material. Thus, compositions containing both the particulate component and a functionalised oil are less susceptible to instability by sedimentation of the solid particulate material out of suspension.

Accordingly, the functionalised oil preferably also functions as a suspending agent in fabric conditioning compositions.

Perfume

The compositions of the invention comprise a perfume.

It is known that perfumes comprise a variety of ingredients, and often as much as 30 to 50 ingredients. A typical perfume mixture for use in a fabric conditioning composition comprises ingredients which are hydrophilic (e.g. benzyl alcohol) as well as ingredients which are hydrophobic (e.g. limonene). Such mixtures are known to have a destabilising influence on fabric conditioning compositions such that a composition free of perfume is generally considered more stable than the same composition comprising a perfume.

Thus, conventional fabric conditioning compositions require that the perfume ingredients are formulated extremely carefully in order to ensure that the perfume not only delivers sufficient perfume but also does not destabilise the composition. This is undesirably complicated.

Surprisingly, the present inventors have found the fabric conditioning emulsions of the present invention are actually more stable when a perfume is present than when a perfume is absent. This provides the advantage that a fabric conditioning composition can be provided which is more tolerant of a variety of perfumes. It is, therefore, easier to formulate both an acceptable perfume and the fabric conditioning composition than for traditional fabric conditioning compositions.

In particular, it has been found that the presence of hydrophobic perfume components is especially advantageous for stability of the emulsion compositions. Thus, at least 50% by number of the perfume components, more preferably 60%, most preferably 70%, e.g. 85% should have a ClogP value equal to or greater than 2.0, more preferably equal to or greater than 3.0, even more preferably equal to or greater than 4.0, most preferably equal to or greater than 5.0, e.g. greater than 6.0 or even 7.0.

In the context of the present invention, ClogP is calculated according to ClogP p.c. program version 3.06, available from Daylight Chemical Information Systems.

Suitable perfumes include those disclosed in "Perfume and Flavor Chemicals (Aroma Chemicals)", by Steffen Arctander, published by the author, 1969, the contents of which are incorporated herein by reference.

The perfume is preferably present in the composition in an amount of 0.01 to 15%, more preferably 0.05 to 12%, most preferably 0.07 to 11% by weight, based on the total weight of the composition.

Without wishing to be bound by theory, it is believed that at least some of the perfume interacts with the solid particulate material rendering it more hydrophobic. This causes the solid particles to adsorb more readily at the water-oil interface which improves the stability of the oil droplets.

Water

The compositions of the invention are aqueous. Preferably the water is present in an amount from 0.01% to 97% by weight, more preferably from 25% to 96% by weight, most preferably 50% to 95% by weight.

Quaternary Ammonium Softening Material

The compositions of the invention may comprise a quaternary ammonium softening material.

The quaternary ammonium softening material may be present in order to assist deposition of other the other ingredients onto fabric and/or it may be present to provide additional softening benefits to fabrics.

The quaternary ammonium material generally comprises one or more fatty hydrocarbyl chains.

Preferably, the average chain length of the alkyl or alkenyl group is at least $C_{14}$, more preferably at least $C_{16}$. Most preferably at least half of the chains have a length of $C_{18}$.

It is generally preferred if the alkyl or alkenyl chains are predominantly linear.

It is especially preferred if the softening material is a water insoluble quaternary ammonium material which comprises a compound having two $C_{12-18}$ alkyl or alkenyl groups connected to the nitrogen head group via at least one ester link. It is more preferred if the quaternary ammonium material has two ester links present.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

A first group of preferred ester-linked cationic surfactant materials for use in the invention is represented by formula (I):

Formula (I)

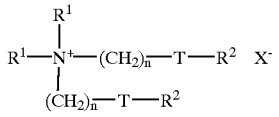

wherein each $R^1$ group is independently selected from $C_{1-4}$ alkyl or $C_{2-4}$ alkenyl groups; and wherein each $R^2$ group is independently selected from $C_{8-28}$ alkyl or alkenyl groups;

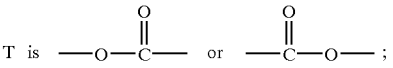

$X^-$ is any anion compatible with the cationic surfactant, such as halides or alkyl sulphates, e.g. chloride, methyl sulphate or ethyl sulphate and n is 0 or an integer from 1–5.

A second preferred softening material for use in the invention is represented by formula (II):

(Formula II)

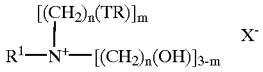

wherein each R is independently selected from a $C_{5-35}$ alkyl or alkenyl group, $R^1$ represents a $C_{1-4}$ alkyl or hydroxyalkyl group or a $C_{2-4}$ alkenyl group, m is 1, 2 or 3 and denotes the number of moieties to which it refers that pend directly from the N atom and T, n and $X^-$ are as defined above.

Especially preferred materials within this formula are di-alkenyl esters of triethanol ammonium methyl sulphate. Commercial examples of compounds within this formula are Tetranyl® AOT-1 (di-oleic ester of triethanol ammonium methyl sulphate 80% active), AO-1(di-oleic ester of triethanol ammonium methyl sulphate 90% active), Tetranyl® AHT-1 (di-hardened tallowyl ester of triethanol ammonium methyl sulphate 85% active), L1/90 (partially hardened tallow ester of triethanol ammonium methyl sulphate 90% active), L5/90 (palm ester of triethanol ammonium methyl sulphate 90% active (supplied by Kao corporation); Rewoquat WE15 ($C_{10}$–$C_{20}$ and $C_{16}$–$C_{18}$ unsaturated fatty acid reaction products with triethanolamine dimethyl sulphate quaternised 90% active), WE18 and WE20 (both are partially hardened tallow ester of triethanol ammonium methyl sulphate 90% active), ex Goldschmidt Corporation; and Stepantex VK-90 (partially hardened tallow ester of triethanol ammonium methyl sulphate 90% active), ex Stepan Company.

A third preferred type of quaternary ammonium material is represented by formula (III):

Formula (III)

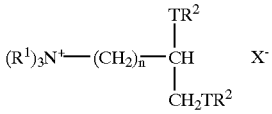

wherein $R^1$, $R^2$, n, T and $X^-$ are as defined above.

Preferred materials of this class such as 1,2 bis [tallowoyloxy]-3-trimethylammonium propane chloride and 1,2-bis[oleyloxy]-3-trimethylammonium propane chloride and their method of preparation are, for example, described in U.S. Pat. No. 4,137,180 (Lever Brothers), the contents of which are incorporated herein. Preferably these materials also comprise small amounts of the corresponding monoester, as described in U.S. Pat. No. 4,137,180.

A fourth preferred type of quaternary ammonium material is represented by formula (IV):

Formula (IV)

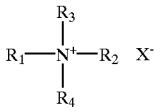

where $R_1$ and $R_2$ are $C_{8-28}$ alkyl or alkenyl groups; $R_3$ and $R_4$ are $C_{1-4}$ alkyl or $C_{2-4}$ alkenyl groups and $X^-$ is as defined above.

Examples of compounds within this formula include di(tallow alkyl)dimethyl ammonium chloride, di(tallow alkyl) dimethyl ammonium methyl sulphate, dihexadecyl dimethyl ammonium chloride, di(hardened tallow alkyl) dimethyl ammonium chloride, dioctadecyl dimethyl ammonium chloride and di(coconut alkyl) dimethyl ammonium chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The quaternary ammonium softening material may be present In an amount from 0.5 to 35%, more preferably 1 to 30%, most preferably 1.5 to 25% by weight based on the total weight of the composition.

The compositions may comprise a cationic fabric softening compound and an oil, for example as disclosed in EP-A-0829531.

Nonionic Softening Agents

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

Nonionic Stabilising Agents

The compositions may also suitably contain a nonionic stabilising agent. Suitable nonionic stabilising agents are linear $C_8$ to $C_{22}$ alcohols alkoxylated with 10 to 25 moles of alkylene oxide, $C_{10}$ to $C_{20}$ alcohols, or mixtures thereof.

Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

Fatty Acids

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

Soil Release Polymers

The fabric conditioning compositions may include soil release polymers such as block copolymers of polyethylene oxide and terephthalate; amphoteric surfactants; zwitterionic quaternary ammonium compounds; and nonionic surfactants.

Amphoteric Surfactants

Amphoteric surfactants may also be used, for example amine oxides or betaines.

Electrolytes

Electrolytes, for example, sodium chloride or calcium chloride, may be present in an amount from 0.01 to 5% by weight.

Anti-Settling Agents

An anti-settling agent may be included in the compositions of the invention. The anti-settling agent, which reduces the tendency of solid particles to separate out from the remainder of a liquid composition, is preferably used in an amount of from 0.5 to 5% by weight of the composition. Suitable anti-settling agents include organophilic quaternised ammonium-clay compounds and fumed silicas.

Flocculating Agents

A further optional ingredient in the compositions of the invention is a flocculating agent which may act as a delivery aid to enhance deposition of the active ingredients (such as the water insoluble particles) onto fabric. Flocculating agents may be present in the compositions of the invention in amounts of up to 10% by weight, based on the weight of the clay. Suitable flocculating agents include polymers, for example long chain polymers and copolymers comprising repeating units derived from monomers such as ethylene oxide, acrylamide, acrylic acid, dimethylaminoethyl methacrylate, vinyl alcohol, vinyl pyrrolidone, ethylene imine and mixtures thereof. Gums such as guar gum, optionally modified, are also suitable for use as flocculating agents.

Other suitable delivery aids for the water insoluble particles include, for example, the water-soluble or water-dispersible rebuild agents (e.g. cellulose monoacetate) described in WO 00/18860.

Further Optional Ingredients

Further optional ingredients in the compositions of the invention include non-aqueous solvents, pearlescers, fluorescers, colourants, hydrotropes, antifoaming agents, optical brightening agents, opacifiers, dye transfer inhibitors, anti-shrinking agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents, and ironing aids. This list is not intended to be exhaustive.

The composition of the present invention is not in the form of a detergent composition.

Thus, it is preferably free of detergent surfactants, such as soap and non-soap anionic surfactants. If soaps and/or non-soap anionic detergents are present, it is preferable that they are present in an amount less than 1% by weight, more preferably less than 0.5% by weight, most preferably less than 0.2% by weight, based on the total weight of the composition.

Product Form

The composition is a pourable liquid, preferably comprising an emulsion.

EXAMPLES

The invention will now be described by way of example only and with reference to the following non-limiting examples.

In the examples all percentages are percentages by weight unless indicated otherwise.

Samples of the invention are denoted by a number and comparative samples are denoted by a letter.

Example 1

Stability of Formulated Product

Sample A comprises an aqueous solution comprising 2.5% by weight of clay (Laundrosil PRW14 ex Sud Chem) and 20% by weight of hexadecane.

Sample B comprises an aqueous solution comprising 10% by weight of hexadecane and 10% by weight of perfume (Softline B53, ex Givaudan Roure).

Sample 1 comprises an aqueous solution comprising 2.5% by weight clay (Laundrosil PRW14 ex Sud Chem), 10% by weight of perfume (Softline B53, ex Givaudan Roure) and 10% by weight hexadecane.

Samples 1, A and B were prepared by adding the ingredients to water and subjecting 10 ml of the mixture to ultrasound for 1 minute using an Ultrasonic Generator Type 7532B (Dawe Instruments).

The compositions were stored in glass bottles for 24 hours at room temperature and then inspected by an expert panel for visible separation. If the bottle contained a layer of clear liquid at the top of height greater than 1 mm the sample was considered unstable. Samples A and B showed layers of clear liquid of at least 5 mm after 24 hours. In sample 1 there was no visible layer of clear liquid. Thus the results demonstrate that both clay and perfume must be present in order to provide a stable oil-based composition.

Example 2

Stability of Perfume Components

An aqueous solution comprising 2.5% by weight clay (Laundrosil PRW14), 10% by weight of a perfume component selected from those in table 1 below, and 10% by weight of hexadecane was prepared.

TABLE 1

| Sample | Perfume Component | ClogP |
|---|---|---|
| C | Benzyl Alcohol | 1.1 |
| D | Benzyl Acetate | 1.96 |
| 2 | Phenyl Alcohol | 3.5 |
| 3 | d-limonene | 4.22 |

The samples were prepared as per samples 1, A and B.

10 ml of each sample was then stored in glass tubes for 24 hours at 37° C. Emulsion stability was assessed by determining the percentage of the oil present which had been released from the emulsion to form a visible layer at the top of the tube.

The results are given in table 2 below:

TABLE 2

| Perfume Component | % of oil released |
|---|---|
| Benzyl Alcohol | 100 |
| Benzyl Acetate | 100 |
| Phenyl Alcohol | 10 |
| d-limonene | 0 |

Where the % of oil released is less than 25%, this is considered to be a stable sample.

Thus, the results show that compositions comprising perfumes only having a ClogP of less than 2 are not desirable.

Example 3

Perfume Intensity

Aqueous solutions comprising 5% by weight of a clay, varying amounts of an oil, 0.064% by weight of perfume and the balance water were prepared as per samples 1, A and B.

TABLE 3

| Sample | E | 4 | 5 |
|---|---|---|---|
| Clay (a) | 5 | 5 | 5 |
| Oil (b) | 0 | 2.5 | 5 |
| Perfume (c) | 0.064 | 0.064 | 0.064 |
| Water | To 100 | To 100 | To 100 |

(a) Laundrosyl PRW14, ex Sud Chemie
(b) Estol 1545, ex Uniqema
(c) Softline B53, ex Givaudan Roure Perfume delivery was assessed as follows:

Three twenty centimetre by twenty centimetre squares of white cotton terry towelling (weighing approximately 40 g total) per treatment are placed in a tergotometer pot containing one liter of demineralised water and agitated at 60–65 rpm for one minute.

The cloths are removed from the pots and excess water is squeezed out by hand. An amount of each sample composition is then added to the pot to provide 0.25% of each sample on weight of fabric and the cloths reintroduced. The pots are agitated at 60–65 rpm for a further five minutes, the cloths removed, excess water removed and line dried overnight.

The cloths are assessed by an expert panel for perfume intensity on a scale of 0 to 5 where 0 denotes no perfume and 5 denotes very strong perfume.

The results are given in table 4.

TABLE 4

| Sample | Perfume score |
|---|---|
| E | 1.31 |
| 4 | 1.82 |
| 5 | 2.51 |

What is claimed is:

1. An aqueous fabric conditioning composition comprising (i) a clay;

(ii) a perfume, of which at least 50% by number of the perfume components have a ClogP value equal to or greater than 2.0; and (iii) a sulfated vegetable oil.

2. A fabric conditioning composition according to claim 1, comprising an emulsion.

3. A fabric conditioning composition according to claim 1 wherein the clay has not been subjected to a cation exchange reaction.

4. A fabric conditioning composition according to claim 1 wherein the clay comprises a smectite-type clay.

5. A fabric conditioning composition according to claim 4 wherein the smectite-type clay is selected from the group consisting of: montmorillonite, bentonite, beidellite, hectorite, saponite, stevensite, and mixtures thereof.

6. A fabric conditioning composition according claim 1 wherein the perfume is present in the composition in an amount of 0.01 to 15% by weight, based on the total weight of the composition.

7. A fabric conditioning composition according to claim 1 wherein the sulfated vegetable oil is sulfated castor oil.

8. A fabric conditioning composition according to claim 1, wherein the clay is present in an amount of from 0.01% to 50% by weight of the composition.

9. A fabric conditioning composition according to claim 1 wherein the oil is present in an amount of from 0.01% to 50% by weight of the composition.

10. A fabric conditioning composition according to claim 1 wherein the weight ratio of clay to oil is in the range of from 10:1 to 1:10.

11. A method of treating fabrics, comprising contacting the fabric conditioning composition as claimed in claim 1 with fabrics during a laundry treatment process.

* * * * *